United States Patent [19]

Fujikawa et al.

[11] 4,190,023

[45] Feb. 26, 1980

[54] COOLING SYSTEM FOR LIQUID-COOLED TYPE OF TWO-CYCLE MULTICYLINDER ENGINE

[75] Inventors: Tetsuzo Fujikawa; Michio Nishimura, both of Kobe, Japan

[73] Assignee: Kawasaki Jukogyo Kabushiki Kaisha, Hyogo, Japan

[21] Appl. No.: 937,075

[22] Filed: Aug. 28, 1978

Related U.S. Application Data

[63] Continuation of Ser. No. 688,027, May 19, 1976, abandoned.

[51] Int. Cl.[2] ..... F02F 1/14

[52] U.S. Cl. ..... 123/41.72; 123/41.74; 123/41.79; 123/41.28

[58] Field of Search ..... 123/41.31, 41.33, 41.72, 123/41.74, 41.75, 41.86, 41.79, 73 E, 193 C, 41.44, 41.28

[56] References Cited

U.S. PATENT DOCUMENTS

| | | | |
|---|---|---|---|
| 3,616,779 | 11/1971 | Newkirk | 23/41.86 |
| 3,911,876 | 10/1975 | Freyn | 123/41.86 |

*Primary Examiner*—Ira S. Lazarus
*Assistant Examiner*—Jeffrey L. Yates
*Attorney, Agent, or Firm*—Toren, McGeady and Stanger

[57] ABSTRACT

A cooling system adapted for a liquid-cooled type of two-cycle multicylinder engine. The thick-walled portion of a crank case between adjacent cylinders is provided with a cooling-liquid passage. The delivery port of a liquid pump is fixedly secured to one end of the cooling-water passage at the intake side of the cylinder, while the other end of the passge at the exhaust side of the cylinders is flow connected to liquid jackets in the cylinder blocks.

1 Claim, 2 Drawing Figures

COOLING SYSTEM FOR LIQUID-COOLED TYPE OF TWO-CYCLE MULTICYLINDER ENGINE

This is a continuation of application Ser. No. 688,027, filed May 19, 1976, now abandoned.

BACKGROUND OF THE INVENTION

This invention relates to a cooling system for a liquid-cooled type of two-cycle multicylinder engine.

There are certain prior art cooling systems in which the delivery port of a water pump mounted on one end of a crank shaft is flow connected to a water passage within a crank case, which is further flow connected directly to a water jacket within a cylinder block for eliminating any piping arrangement. However, such conventional cooling systems require an increase in wall thickness of a portion of the crank case to provide therein the water passage in the axial direction of the crank shaft, and hence had a disadvantage that the crank case becomes greater in size. Furthermore, the water pump mounted on the end of the crank shaft increased disadvantageously the overall length of the engine in the axial direction of the crank shaft.

The prior art to which the invention is directed also includes another type of cooling systems in which cooling hoses are used for piping. Such cooling systems require longer and complicated piping because of a number of hoses extending along the outside of an engine, which resulted in increase in the number of parts and higher cost for manufacturing.

BRIEF SUMMARY OF THE INVENTION

Accordingly, it is an object of the present invention to provide a cooling system for a liquid-cooled type of two-cycle multicylinder engine in which the above-mentioned disadvantages are eliminated, the space between adjacent cylinders is utilized effectively and the distance for piping is decreased.

It is another object of the invention to provide a cooling system for a crank case compression type of two-cycle engine which permits an increase in delivery ratio.

According to the present invention, there is provided a cooling system comprising a cooling-liquid passage formed in a thick-walled portion of a crank case between adjacent cylinders, a liquid pump having a delivery port fixedly secured to one end of said cooling-liquid passage at the suction side of the cylinder and means for flow connecting the other end of the cooling-liquid passage at the exhaust side of the cylinders to water jackets in the cylinders.

These and other objects, features and advantages of the invention will become more apparent upon a reading of the following detailed specification and drawings, in which:

FIG. 1 is a vertical sectional view taken on the center of a crank shaft of an engine illustrating an embodiment of the present invention; and FIG. 2 is a sectional view taken along the line II—II of FIG. 1.

DETAILED DESCRIPTION

Figure 1:
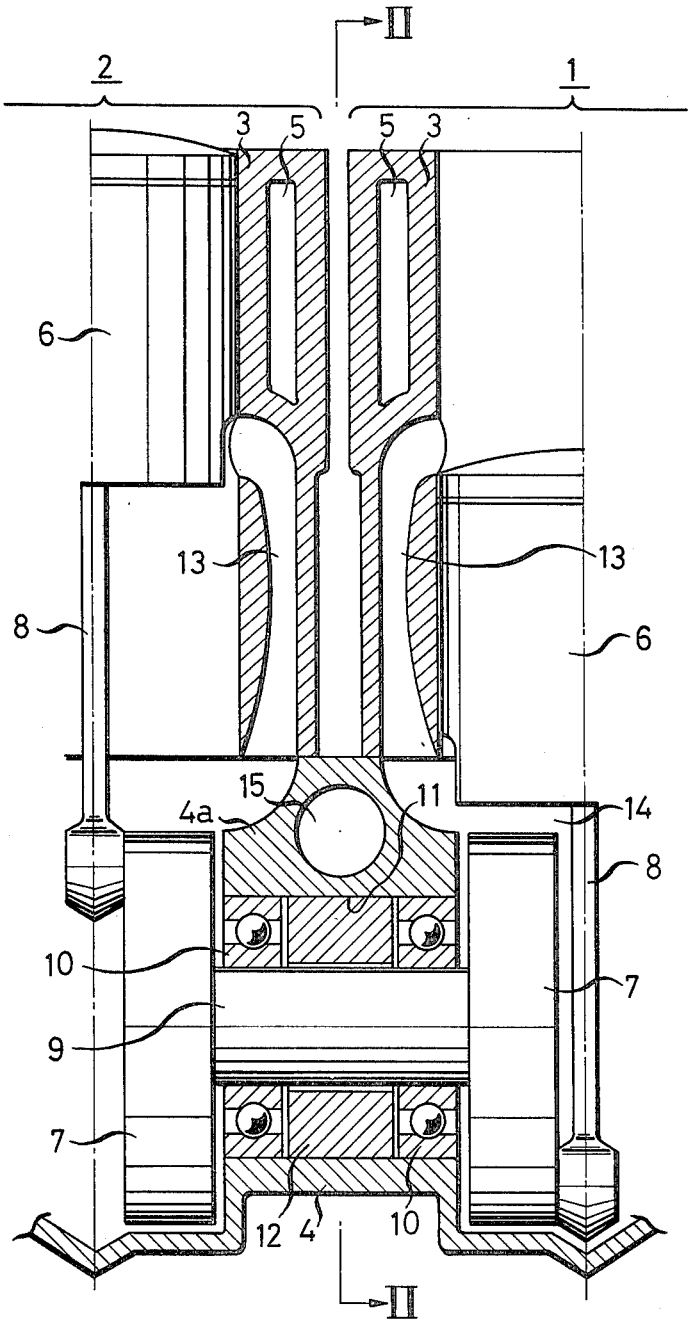

Referring to FIG. 1, the reference numerals 1 and 2 indicate a first cylinder and a second cylinder, respectively. These cylinders 1 and 2 are constituted by cylinder blocks 3, 3 and a crank case 4. The cylinder blocks 3, 3 and the crank case 4 are firmly connected with each other. Alternatively, cylinder blocks 3, 3 may be integrally formed. Each of the cylinder blocks 3, 3 is formed with a liquid jacket 5, and pistons 6, 6 within the cylinder blocks 3, 3 are each pivotally connected to a crank web or counterweight 7 through a connecting rod 8. The jackets are filled with a cooling liquid such as water, an anti-freeze solution or similar liquid. The crank webs 7, 7 are firmly fixed to ends of a crank shaft 9 and the liquid jacket or cooling passage 5 is located in proximity to the crankshaft 9 and approximately midway between the crank webs 7, 7. The crank shaft 9 is rotatably supported by means of bearings 10, 10 mounted in a bearing bore 11 of the crank case 4. The reference numeral 12 indicates a labyrinth seal and 13, 13 scavenging passages perforated in the cylinder blocks 3, 3. In case of the integrally formed cylinder blocks 3, 3, the jackets 5, 5 may communicate with each other in the blocks 3, 3.

Hereupon, it is to be noted that in a water-cooled type of two-cycle multicylinder engine, there is originally a greater space in the crank case between adjacent cylinders, and in view of such respect the present invention contemplates to utilize effectively such space. That is, a portion 4*a* of the crank case 4 enclosed by the scavenging passages 13, 13 at both sides and the bearing bore 11 is generally formed thickly. This is because firstly the volume of a crank chamber 14 is made less in order to increase the compression ratio in the crank chamber and secondly there is a limit to decrease in the distance between adjacent cylinders because of the liquid jackets 5, 5 provided in the wall of cylinder blocks 3, 3. Therefore, according to the invention, a cooling-liquid passage 15 having a relatively great diameter is perforated in the thick-walled portion 4*a* between the adjacent cylinders at right angles to the axis of the crank shaft 9.

Figure 2:
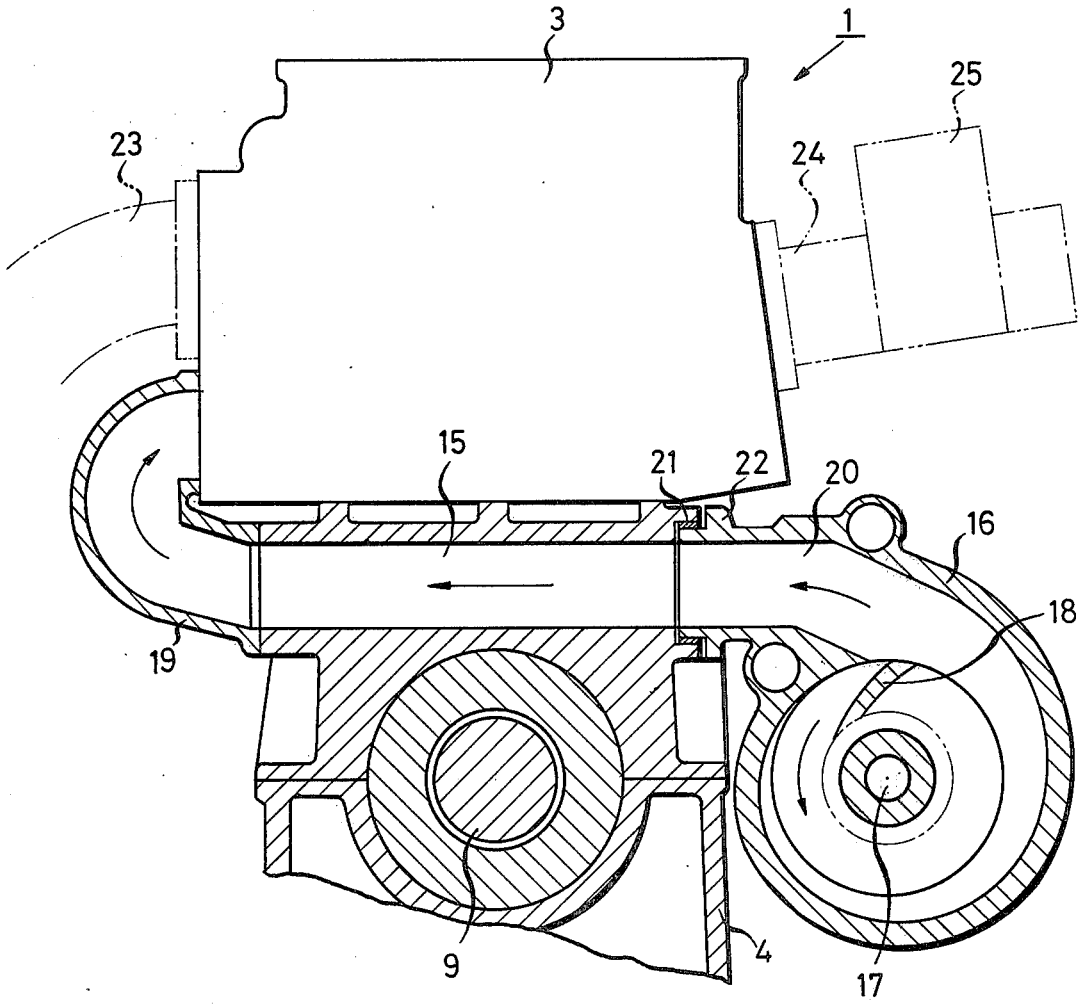

Now referring to FIG. 2 showing a section taken along the line II—II of FIG. 1, the reference numeral 16 indicates a liquid pump, 17 a pump shaft, 18 an impeller mounted on the pump shaft 18, and 19 a pipe such as bend pipe, branch pipe or the like. The cooling-liquid passage 15 is flow connected to the jackets 5, 5 in the cylinder blocks 3, 3 by the pipe 19. A delivery port 20 of the water pump 16 is fitted in the end portion of the liquid-cooling passage 15 at the intake side of the cylinders through a O-ring 21 and fastened at its flange portion 22 to the crank case 4 by means of bolts (not shown). The shaft 17 of the water pump 16 is connected to the crank shaft 9 through a power transmission means such as gears, chain, belt or the like and adapted to be rotated in the arrow-marked direction.

In operation, upon rotation of the impeller 18, pressure is applied to a cooling-liquid within a suction port (not shown) which communicates with a radiator (not shown), and the cooling-liquid is introduced into the liquid jackets at the exhaust side in the first and second cylinders 1 and 2 through the delivery port 20, cooling-liquid passage 15 and the pipe 19. The other numeral 23 indicates an exhaust manifold, 24 a suction manifold and 25 a carburetor.

In this way, the cooling system according to the invention is of such construction that the generally thick-walled portion 4*a* of the crank case between adjacent cylinders is provided with the cooling-liquid passage 15 at right angles to the axis of the crank shaft 9, and the delivery port 20 of the water pump is flow connected to the end of the passage 15 at the suction side of the cylinder. With such construction, the liquid pump 16 can be mounted on the crank case in a relatively wide space below the carburetor 25, whereby the distance for piping of the pipe 19 may be decreased and there is no possibility of increasing the configuration of the crank case 4. Further, the provision of the cooling-liquid passage 15 permits the crank case 4 to be cooled and, with a crank case compression type of two-cycle engine, also permits an increase in the delivery ratio so that some increases in output may be expected. In addition, the cooling system according to the invention is simple in construction and easy to manufacture.

Obviously, many modifications and variations of the present invention are possible in the light of the above teachings. For example, gaskets may be interposed in place of O-ring 21 between the delivery port 20 and crank case 4, and between the pipe 19 and crank case 4. Further, the end of the cooling-liquid passage 15 at the exhaust side of the cylinders may be flow connected directly to the liquid jackets in the cylinder blocks 3, 3 through a passage traversing the joint surfaces of the cylinder blocks 3, 3 and crank case 4 to thereby eliminate the pipe 19. In the drawing, the cooling-liquid passage 15 is provided between the crank shaft 7 and cylinder blocks 3 between the adjacent cylinders, but it may be provided below the crank shaft 7.

What we claim is:

1. In a two-cycle multicylinder engine including cylinder block means defining at least a pair of cylinders located adjacent each other, said pair of cylinders defining a first side and a second side opposite thereto, carburetor means including fuel intake means for said pair of cylinders located on said first side of said pair of cylinders, exhaust means located on said second side of said pair of cylinders, a crankcase including a thick-walled portion thereof located in an area generally between said adjacent cylinders, a crankshaft approximately equidistantly spaced between said first and second sides, piston means operatively associated with said cylinder means, connecting rod means and crank web means operatively interconnecting said piston means with said crankshaft, said crank web means including a pair of crank webs located on opposite ends of said crankshaft, crankshaft bearing means located between said crankshaft and said thick-walled portion of the crankcase, and liquid jackets located in said cylinder block means, the improvement comprising:

a cooling system for said engine consisting essentially of a cooling liquid passage formed to extend through said thick-walled portion of said crankcase in a generally straight configuration from said first side to said second side of said pair of cylinders at a location generally equivalently spaced from each of said adjacent cylinders;

said cooling liquid passage being located in an area generally above said crankshaft and being in the form of a throughhole formed through said thick-walled portion of the crankcase and located in proximity to said crankshaft bearing means at a point approximately equidistantly spaced from said pair of crank webs;

a liquid pump having a delivery port connected in flow communication to one end of said coupling liquid passage at said first side of said pair of cylinders said liquid pump being mounted beneath said carburetor means and attached to said crankcase at said first side of said pair of cylinders; and means on said second side of said pair of cylinders flow-connecting the other end of said cooling liquid passage to said liquid jacket in said cylinder block means at a location adjacent said exhaust means.

* * * * *